US007559812B2

(12) United States Patent
Yamada et al.

(10) Patent No.: US 7,559,812 B2
(45) Date of Patent: Jul. 14, 2009

(54) BOAT

(75) Inventors: Takashi Yamada, Shizuoka-ken (JP); Masaru Kawanishi, Shizuoka-ken (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/694,422

(22) Filed: Mar. 30, 2007

(65) Prior Publication Data

US 2008/0020656 A1 Jan. 24, 2008

(30) Foreign Application Priority Data

Jul. 24, 2006 (JP) ..... 2006-200789

(51) Int. Cl.
*B63H 20/00* (2006.01)
*B63H 21/22* (2006.01)
*F02D 29/02* (2006.01)
*F02D 45/00* (2006.01)

(52) U.S. Cl. ..... 440/2; 701/21

(58) Field of Classification Search ..... 440/1, 440/2, 84; 701/21

See application file for complete search history.

(56) References Cited

U.S. PATENT DOCUMENTS

| | | | |
|---|---|---|---|
| 1,843,272 | A | 2/1932 | Evinrude |
| 2,204,265 | A | 6/1940 | Wentzel |
| 2,466,282 | A | 4/1949 | Sparrow et al. |
| 2,740,260 | A | 4/1956 | Blanchard |
| 3,986,363 | A | 10/1976 | Beaman et al. |
| 4,412,422 | A | 11/1983 | Rossi |

(Continued)

FOREIGN PATENT DOCUMENTS

| | | |
|---|---|---|
| JP | 01-119499 | 5/1989 |

(Continued)

OTHER PUBLICATIONS

International Standard, ISO 11783-5, First Edition May 1, 2001; *Tractors and Machinery for Agriculture and Forestry-Serial Control and Communications Data Network—Part 5: Network Management.*

(Continued)

*Primary Examiner*—Ajay Vasudeva
(74) *Attorney, Agent, or Firm*—Knobbe, Martens, Olson & Bear, LLP

(57) ABSTRACT

A boat capable of assigning device instance numbers in accordance with the placement order of boat propulsion units, irrespective of the activation order of the boat propulsion units, comprises a plurality of control units for controlling a plurality of boat propulsion units. A plurality of gauge sections for displaying operation information of the respective boat propulsion units are connected to each other and to the plurality of control units via a communication network. The respective control units assign device instance numbers to the operation information of the boat propulsion units and transmit the device instance numbers, and the respective gauge sections identify and receive the device instance numbers for display. The control units are connected to each other via a communication line, and respectively include DI-number setting sections capable of setting device instance numbers, and determining sections capable of determining the positions of the boat propulsion units. The DI-number setting sections are adapted to set device instance numbers based on the number of the control units, and the positions of the boat propulsion units.

16 Claims, 4 Drawing Sheets

U.S. PATENT DOCUMENTS

| | | | | |
|---|---|---|---|---|
| 4,493,662 | A | 1/1985 | Taguchi | |
| 4,497,057 | A | 1/1985 | Kato et al. | |
| 4,527,441 | A | 7/1985 | Nakahama | |
| 4,549,869 | A | 10/1985 | Iida | |
| 4,570,776 | A | 2/1986 | Iwashita . | |
| 4,579,204 | A | 4/1986 | Iio | |
| 4,622,938 | A | 11/1986 | Wenstadt et al. | |
| 4,646,696 | A | 3/1987 | Dogadko | |
| 4,648,497 | A | 3/1987 | Prince | |
| 4,708,669 | A | 11/1987 | Kanno et al. | |
| 4,747,381 | A | 5/1988 | Baltz et al. | |
| 4,755,156 | A | 7/1988 | Wagner | |
| 4,788,955 | A | 12/1988 | Wood | |
| 4,796,206 | A | 1/1989 | Boscove et al. | |
| 4,801,282 | A | 1/1989 | Ogawa | |
| 4,805,396 | A | 2/1989 | Veerhusen et al. | |
| 4,809,506 | A | 3/1989 | Lauritsen | |
| 4,810,216 | A | 3/1989 | Kawamura | |
| 4,822,307 | A | 4/1989 | Kanno | |
| 4,836,809 | A | 6/1989 | Pelligrino | |
| 4,843,914 | A | 7/1989 | Korke | |
| 4,850,906 | A | 7/1989 | Kanno et al. | |
| 4,858,585 | A | 8/1989 | Remmers | |
| 4,898,045 | A | 2/1990 | Baba | |
| 4,903,662 | A | 2/1990 | Hirukawa | |
| 4,924,724 | A | 5/1990 | Yoshimura | |
| 4,963,109 | A | 10/1990 | Hayasaka | |
| 4,964,276 | A | 10/1990 | Sturdy | |
| 4,973,274 | A | 11/1990 | Hirukawa | |
| 5,004,962 | A | 4/1991 | Fonss et al. | |
| 5,006,084 | A | 4/1991 | Handa | |
| 5,050,461 | A | 9/1991 | Onoue | |
| 5,051,102 | A | 9/1991 | Onoue | |
| 5,059,144 | A | 10/1991 | Onoue | |
| 5,062,403 | A | 11/1991 | Breckenfeld et al. | |
| 5,062,516 | A | 11/1991 | Prince | |
| 5,065,723 | A | 11/1991 | Broughton et al. | |
| 5,072,629 | A | 12/1991 | Hirukawa | |
| 5,076,113 | A | 12/1991 | Hayasaka | |
| 5,103,946 | A | 4/1992 | Masters et al. | |
| 5,127,858 | A | 7/1992 | Pelligrino et al. | |
| 5,136,279 | A | 8/1992 | Kanno | |
| 5,157,956 | A | 10/1992 | Isaji et al. | |
| 5,167,212 | A | 12/1992 | Peter et al. | |
| 5,201,238 | A | 4/1993 | Hayasaka | |
| 5,231,890 | A | 8/1993 | Hayasaka | |
| 5,245,324 | A | 9/1993 | Jonker et al. | |
| 5,273,016 | A | 12/1993 | Gillespie et al. | |
| 5,318,466 | A | 6/1994 | Nagafusa | |
| 5,325,082 | A | 6/1994 | Rodriguez | |
| 5,349,644 | A | 9/1994 | Massey | |
| 5,381,769 | A | 1/1995 | Nishigaki et al. | |
| 5,408,230 | A | 4/1995 | Okita | |
| 5,445,546 | A | 8/1995 | Nakamura | |
| 5,481,261 | A | 1/1996 | Kanno | |
| 5,492,493 | A | 2/1996 | Ohkita | |
| 5,539,294 | A | 7/1996 | Kobayashi | |
| 5,556,312 | A | 9/1996 | Ogino | |
| 5,556,313 | A | 9/1996 | Ogino | |
| 5,575,698 | A | 11/1996 | Ogino | |
| 5,595,159 | A | 1/1997 | Huber et al. | |
| 5,597,334 | A | 1/1997 | Ogino | |
| 5,633,573 | A | 5/1997 | van Phuoc et al. | |
| 5,664,542 | A | 9/1997 | Kanazawa et al. | |
| 5,687,694 | A | 11/1997 | Kanno | |
| 5,692,931 | A | 12/1997 | Kawai | |
| 5,697,821 | A | 12/1997 | Ogino | |
| 5,730,105 | A | 3/1998 | McGinnity | |
| 5,749,343 | A | 5/1998 | Nichols et al. | |
| 5,771,860 | A | 6/1998 | Bernardi | |
| 5,782,659 | A | 7/1998 | Motose | |
| 5,788,546 | A | 8/1998 | Ogino | |
| 5,827,150 | A | 10/1998 | Mukumoto | |
| 5,839,928 | A | 11/1998 | Nakayasu | |
| 5,852,789 | A | 12/1998 | Trsar et al. | |
| 5,899,191 | A | 5/1999 | Rabbit et al. | |
| 5,910,191 | A | 6/1999 | Okamoto | |
| 5,935,187 | A | 8/1999 | Trsar et al. | |
| 6,015,317 | A | 1/2000 | Hoshiba et al. | |
| 6,015,319 | A | 1/2000 | Tanaka | |
| 6,026,783 | A | 2/2000 | Nestvall et al. | |
| 6,055,468 | A | 4/2000 | Kaman et al. | |
| 6,058,349 | A | 5/2000 | Kikori et al. | |
| 6,067,008 | A | 5/2000 | Smith | |
| 6,067,009 | A | 5/2000 | Hozuka et al. | |
| 6,073,509 | A | 6/2000 | Salecker et al. | |
| 6,073,592 | A | 6/2000 | Brown et al. | |
| 6,085,684 | A | 7/2000 | Cotton | |
| 6,095,488 | A | 8/2000 | Semeyn, Jr. et al. | |
| 6,098,591 | A | 8/2000 | Iwata | |
| 6,102,755 | A | 8/2000 | Hoshiba | |
| 6,109,986 | A | 8/2000 | Gaynor et al. | |
| 6,123,591 | A | 9/2000 | Onoue | |
| 6,141,608 | A | 10/2000 | Rother | |
| 6,174,264 | B1 | 1/2001 | Hoshiba | |
| 6,217,400 | B1 | 4/2001 | Natsume | |
| 6,217,480 | B1 | 4/2001 | Iwata | |
| 6,233,943 | B1 | 5/2001 | Beacom et al. | |
| 6,273,771 | B1 | 8/2001 | Buckley et al. | |
| 6,280,269 | B1 | 8/2001 | Gaynor | |
| 6,351,704 | B1 | 2/2002 | Koerner | |
| 6,377,879 | B2 | 4/2002 | Kanno | |
| 6,379,114 | B1 | 4/2002 | Schott et al. | |
| 6,382,122 | B1 * | 5/2002 | Gaynor et al. | 114/144 RE |
| 6,414,607 | B1 | 7/2002 | Gonring et al. | |
| 6,529,808 | B1 | 3/2003 | Diem | |
| 6,536,409 | B1 | 3/2003 | Takahashi et al. | |
| 6,587,765 | B1 | 7/2003 | Graham et al. | |
| 6,599,158 | B2 | 7/2003 | Shidara et al. | |
| 6,612,882 | B2 | 9/2003 | Shidara et al. | |
| 6,691,023 | B2 | 2/2004 | Fujino et al. | |
| 6,704,643 | B1 | 3/2004 | Suhre et al. | |
| 6,751,533 | B2 | 6/2004 | Graham et al. | |
| 6,859,692 | B2 | 2/2005 | Okuyama | |
| 6,910,927 | B2 | 6/2005 | Kanno | |
| 6,965,817 | B2 | 11/2005 | Graham et al. | |
| 7,108,570 | B2 | 9/2006 | Okuyama | |
| 7,121,908 | B2 | 10/2006 | Okuyama | |
| 7,142,955 | B1 | 11/2006 | Kern et al. | |
| 7,153,174 | B2 | 12/2006 | Takada et al. | |
| 7,166,003 | B2 | 1/2007 | Motose | |
| 7,220,153 | B2 | 5/2007 | Okuyama | |
| 2001/0049579 | A1 | 12/2001 | Fujino et al. | |
| 2003/0060946 | A1 | 3/2003 | Okuyama et al. | |
| 2003/0060952 | A1 | 3/2003 | Kanno et al. | |
| 2003/0061076 | A1 | 3/2003 | Okuyama et al. | |
| 2003/0082962 | A1 * | 5/2003 | Kanno | 440/2 |
| 2003/0092331 | A1 | 5/2003 | Okuyama | |
| 2003/0093196 | A1 | 5/2003 | Okuyama | |
| 2004/0029461 | A1 | 2/2004 | Shomura | |
| 2005/0085141 | A1 | 4/2005 | Motose | |
| 2005/0118895 | A1 | 6/2005 | Kanno et al. | |
| 2005/0118896 | A1 * | 6/2005 | Okuyama et al. | 440/2 |
| 2005/0241425 | A1 | 11/2005 | Oguma | |
| 2005/0245145 | A1 | 11/2005 | Takada et al. | |
| 2005/0267654 | A1 | 12/2005 | Okuyama et al. | |
| 2005/0286539 | A1 | 12/2005 | Okuyama | |
| 2006/0154537 | A1 | 7/2006 | Mizushima et al. | |
| 2006/0240720 | A1 | 10/2006 | Yamashita et al. | |
| 2007/0082565 | A1 | 4/2007 | Okuyama | |
| 2007/0082566 | A1 | 4/2007 | Okuyama | |
| 2007/0178780 | A1 | 8/2007 | Ito et al. | |
| 2007/0218785 | A1 | 9/2007 | Okuyama | |
| 2007/0227429 | A1 | 10/2007 | Okuyama et al. | |

| | | | |
|---|---|---|---|
| 2007/0232162 | A1 | 10/2007 | Okuyama et al. |
| 2007/0249244 | A1 | 10/2007 | Watanabe et al. |
| 2007/0250222 | A1 | 10/2007 | Okuyama et al. |
| 2007/0270055 | A1 | 11/2007 | Ito et al. |
| 2007/0282490 | A1 | 12/2007 | Ito et al. |
| 2007/0293102 | A1 | 12/2007 | Okuyama et al. |
| 2008/0003898 | A1 | 1/2008 | Watanabe et al. |

FOREIGN PATENT DOCUMENTS

| | | |
|---|---|---|
| JP | 03-061196 | 3/1991 |
| JP | 07-133733 | 5/1995 |
| JP | 11-334694 | 12/1999 |
| JP | 2001-107752 | 4/2001 |
| JP | 2001-260986 | 9/2001 |
| JP | 2003-098044 | 4/2003 |
| JP | 2003-127986 | 5/2003 |
| JP | 2003-146293 | 5/2003 |
| JP | 2004-036574 | 2/2004 |
| JP | 2004-068704 | 3/2004 |
| JP | 2004-244003 | 9/2004 |
| JP | 2004-286018 | 10/2004 |
| JP | 2005-161906 | 6/2005 |
| JP | 2005-297785 | 10/2005 |
| WO | WO 2005-102833 | 11/2005 |

OTHER PUBLICATIONS

NMEA 2000; Standard for Serial Data Networking of Marine Electronic Devices; Main Document: Version 1.000, Sep. 12, 2001; @NMEA 1999, 2000, 2001.
NMEA 2000; Standard for Serial Data Networking of Marine Electronic Devices; Appendix A: Version 1.000, Sep. 12, 2001; @NMEA 1999, 2000, 2001.
NMEA 2000; Standard for Serial Data Networking of Marine Electronic Devices; Appendix B: @NMEA 1999, 2000, 2001.
NMEA 2000; Standard for Serial Data Networking of Marine Electronic Devices; Appendix C: Version 1.000, Sep. 12, 2001; @NMEA 1999, 2000, 2001.
NMEA 2000; Standard for Serial Data Networking of Marine Electronic Devices; Appendix D: Version 1.000, Sep. 12, 2001; @NMEA 1999, 2000, 2001.
NMEA 2000; Standard for Serial Data Networking of Marine Electronic Devices; Appendix E: ISO 11783-5 Network Management.
NMEA 2000; Standard for Serial Data Networking of Marine Electronic Devices; Appendix F: ISO 11783-5 DataLink Layer.
NMEA 2000; Standard for Serial Data Networking of Marine Electronic Devices; Appendix G: ISO 11898 Controller Area Network.
Product catalog of i6000TEC—Triple Engine Electronic Shift & throttle of Teleflex Morse Co., Ltd. (USA).
Barron, Jim. "Get on the Bus." Trailer Boats Magazine, Jun. 2000, p. 36.
Spisak, Larry. "Know it by Chart." Boating Magazine, May 2000, p. 100.
J.D. "Gains in technology will alter makeup of the . . . " Boating Industry International, Nov. 2000.
Declaration of Daniel J. Carr.
Denn, James. "Future boats sales will hinge on technology." Boating Industry International, Nov. 2000.
Hemmel, Jeff. "Information, Please—The digital boating revolution begins." Boating Magazine, Sep. 2000.
Kelly, Chris. "Can We Talk?" Power & Motoryacht Magazine, Jun. 2000, pp. 36 & 38, 39.
"Plug and Play" Advertisement from "Motorboating", Dec. 2000, p. 57.
"MagicBus i3000 Series Intelligent Steering" Instruction Manual. Telefex, Inc.
Search Report for PCT/JP2005/000175, mailed Mar. 1, 2005.
Office Action mailed Apr. 18, 2008 received in U.S. Appl. No. 11/103,997.
Office Action mailed Nov. 5, 2007 received in U.S. Appl. No. 11/195,246.
Office Action mailed Jun. 27, 2008 received in U.S. Appl. No. 11/195,246.
Office Action mailed Apr. 10, 2006 received in U.S. Appl. No. 11/240,689.
Office Action mailed Jul. 24, 2006 received in U.S. Appl. No. 11/240,689.
Office Action mailed Feb. 26, 2007 received in U.S. Appl. No. 11/240,689.
Office Action mailed Oct. 19, 2007 received in U.S. Appl. No. 11/240,689.
Office Action mailed Oct. 31, 2007 received in U.S. Appl. No. 11/523,920.
Office Action mailed Jun. 18, 2008 received in U.S. Appl. No. 11/523,920.
Office Action mailed Nov. 16, 2007 received in U.S. Appl. No. 11/617,508.
Office Action mailed Apr. 14, 2008 received in U.S. Appl. No. 11/688,127.
Office Action mailed Feb. 7, 2008 received in U.S. Appl. No. 11/371,691.
Office Action mailed Apr. 21, 2008 received in U.S. Appl. No. 11/371,691.
Office Action mailed Apr. 15, 2008 received in U.S. Appl. No. 11/688,818.
Office Action mailed Feb. 27, 2008 received in U.S. Appl. No. 11/731,086.

* cited by examiner

BOAT

CROSS-REFERENCE TO RELATED APPLICATIONS

The present application is based on and claims priority under 35 U.S.C. § 119 to Japanese Patent Application No. 2006-200789, filed on Jul. 24, 2006, the entire contents of which are expressly incorporated by reference herein.

BACKGROUND OF THE INVENTION

1. Field of the Invention

The present invention relates to a boat in which operation information of each of a plurality of boat propulsion units is assigned a device instance number and transmitted via a communication network, and the operation information is displayed in each of a plurality of gauge sections provided in correspondence with the respective boat propulsion units.

2. Description of the Related Art

A boat having one or more outboard motors is provided with gauge sections for displaying the navigation speed and remaining fuel amount, engine speed and engine temperature of outboard motors, and the like. In the related art, it is known to connect these plurality of boat gauge sections and outboard motors to each other via a communication network such as CAN (control area network), and to transmit various kinds of information via the communication network.

A boat of this type includes, for example, a plurality of outboard motors, and a plurality of gauge sections corresponding to the respective outboard motors. Different device instance numbers can be set with respect to individual outboard motors. The device instance numbers are assigned to the operation information of the respective outboard motors and can be transmitted to a communication network. On the other hand, by configuring the respective gauge sections so as to be capable of identifying and receiving the device instance numbers of the respective corresponding outboard motors, it is possible to transmit the operation information of the respective outboard motors to the corresponding gauge sections for display.

A method of setting different device numbers with respect to a plurality of units, for example, is described in connection with the system disclosed in Japanese Publication No. JP 2005-161906. In this system, for example, a plurality of ECUs corresponding to a plurality of outboard motors are each provided with a number setting section, and the same initial value is set with respect to the respective number setting sections in advance. Upon activating each outboard motor, if the device instance number of another outboard motor is not received via a communication network, the initial value is set as the device instance number of that outboard motor, while if the device instance number of another outboard motor is received via the communication network, a device instance number different from the received device instance number is set as the device instance number.

In this case, since the same number is set as the initial value, upon activating the second outboard motor onward, the same number will be received. Accordingly, in the number setting section corresponding to the next outboard motor, a different device instance number is set by moving up the number to the smallest value that does not overlap with the number of the previously activated outboard motor.

On the other hand, the respective gauge sections are configured so as to be capable of selecting small device instance numbers in the order of placement.

According to the system as described above, by activating the plurality of outboard motors in their placement order, device instance numbers that accord with the placement order can be set with respect to the outboard motors. Further, it is possible to set the device instance numbers of the corresponding outboard motors sequentially with respect to the corresponding gauge sections. Accordingly, there is no need to use a special jig or the like for setting the device instance numbers, and device instance numbers can be readily set in the arrangement order of the outboard motors in accordance with a standard such as NMEA with respect to a plurality of outboard motors or the like.

However, if device instance numbers are set in accordance with the placement order in this way, when the outboard motors are activated in an order different from the order of their placement, device instance numbers that are not in accord with the placement order are set to the respective outboard motors and gauge sections. Accordingly, the activation order of the outboard motors is specified, which makes the setting operation cumbersome.

SUMMARY OF THE INVENTION

In view of the circumstances noted above, an aspect of at least one of the embodiments disclosed herein is to provide a boat in which device instance numbers that accord with the placement order of boat propulsion units can be assigned irrespective of the activation order of the boat propulsion units.

In accordance with one aspect of the invention, a boat is provided comprising a plurality of boat propulsion units and a plurality of control unites for controlling the plurality of boat propulsion units. The boat also comprises a plurality of gauge sections for displaying operation information of the boat propulsion units. The plurality of control units and the plurality of gauge sections are connected to each other via a communication network. The control units are configured to assign different device instance (DI) numbers to operation information of the corresponding boat propulsion units and configured to transmit the operation information with the assigned device instance number, each gauge section configured to identify the device instance numbers to receive and display the operation information of the corresponding boat propulsion unit. The plurality of control units are connected to each other via one or more communication lines, each control unit including a DI-number setting section capable of setting the device instance number, and a determining section capable of determining a position of the boat propulsion unit corresponding to the control unit. The DI-number setting section is configured to set the device instance number based on the number of the control units recognized with the one or more communication lines, and the position of the boat propulsion unit determined by the determining section.

In accordance with another aspect of the invention, a boat is provided comprising a plurality of boat propulsion units and a plurality of control units for controlling the plurality of boat propulsion units. The boat also comprises a plurality of gauge sections for displaying operation information of the boat propulsion units. The plurality of control units and the plurality of gauge sections are connected to each other via a communication network. The control units are configured to assign different device instance (DI) numbers to operation information of the corresponding boat propulsion units and configured to transmit the operation information with the assigned device instance number. Each gauge section is configured to identify the device instance numbers to receive and display the operation information of the corresponding boat propulsion units. Each of the control units includes a DI-number setting section capable of setting the device instance number, and a determining section capable of determining the position of the boat propulsion unit corresponding to the control unit. The gauge sections connected to each other via a communication line, the device instance numbers with values different from each other being set in advance for each of the gauge sections. Each gauge section includes a DI-number identifying section capable of identifying and receiving the operation information assigned with the same device instance number as the device instance number set for the gauge section, the DI-number identifying section identifying the corresponding control unit based on the number of the gauge sections and the device instance number, and setting the device instance number in the DI-number setting section of the control unit.

In accordance with yet another aspect of the invention, a boat is provided comprising a plurality of control units for controlling a plurality of boat propulsion units, the plurality of control units connected to each other via one or more communication lines. The boat also comprises a plurality of gauge sections for displaying operation information of the boat propulsion units, the plurality of control units and the plurality of gauge sections connected to each other via a communication network. The boat further comprises means for identifying the ordinal position of the propulsion unit that corresponds to each control unit and each gauge section relative to the plurality of propulsion units, and for transmitting the operation information of said propulsion unit to the corresponding gauge section via the corresponding control unit irrespective of the order in which the propulsion units are activated.

In accordance with still another aspect of the invention, a method of associating operation information of a plurality of boat propulsion units for a boat is provided. The method comprises recognizing the number of operating boat propulsion units attached to the boat, determining an ordinal position of each of the operating boat propulsion units, and assigning device instance numbers (DI) in accordance with the positional order of each of the operating boat propulsion units irrespective of the order in which the boat propulsion units are activated.

BRIEF DESCRIPTION OF THE DRAWINGS

These and other features, aspects and advantages of the present inventions will now be described in connection with preferred embodiments, in reference to the accompanying drawings. The illustrated embodiments, however, are merely examples and are not intended to limit the inventions. The drawings include the following 4 figures.

DETAILED DESCRIPTION OF THE PREFERRED EMBODIMENT

Figure 1:
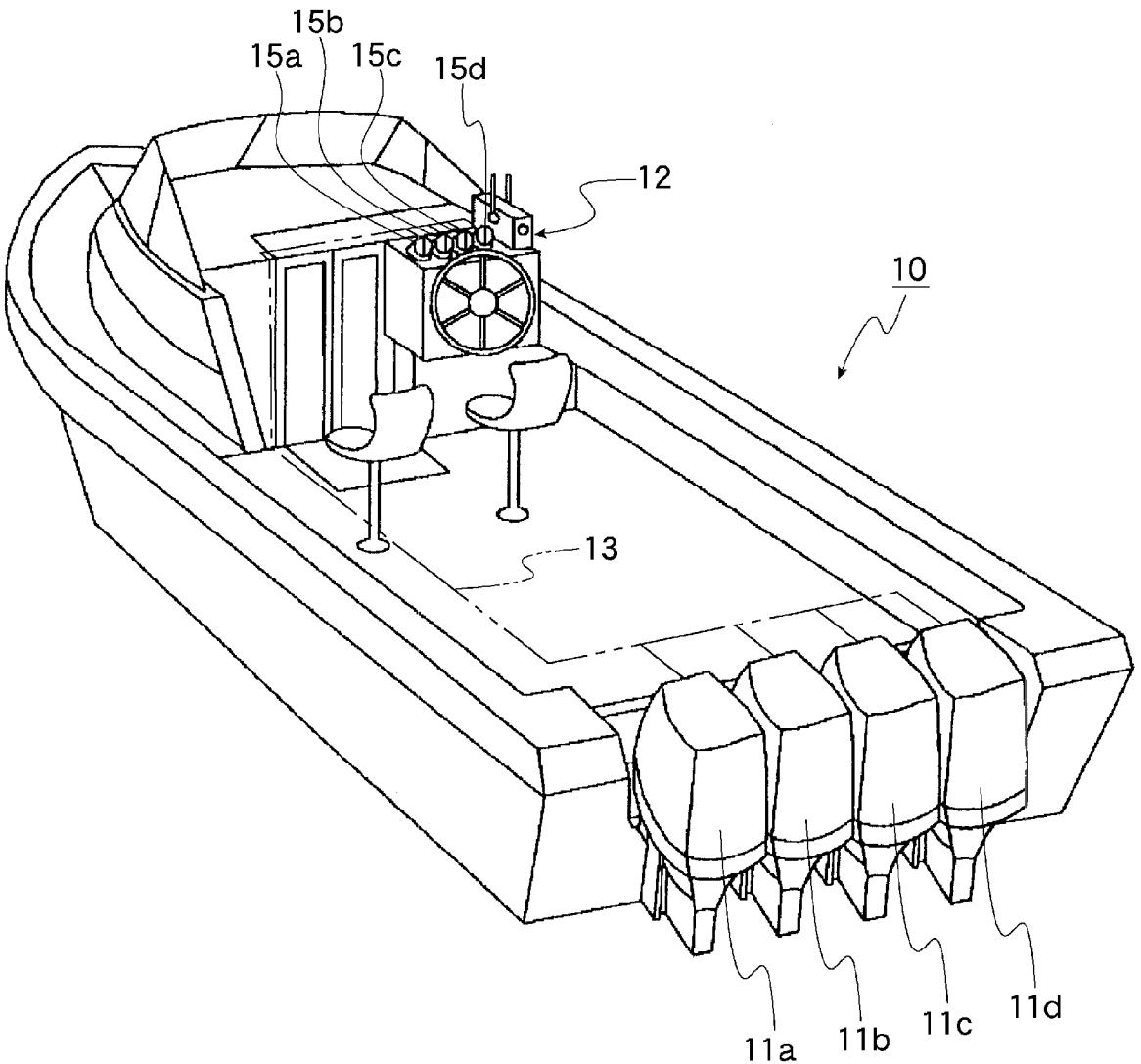
FIG. 1 is a schematic perspective view, showing a boat according to one embodiment.
Figure 2:
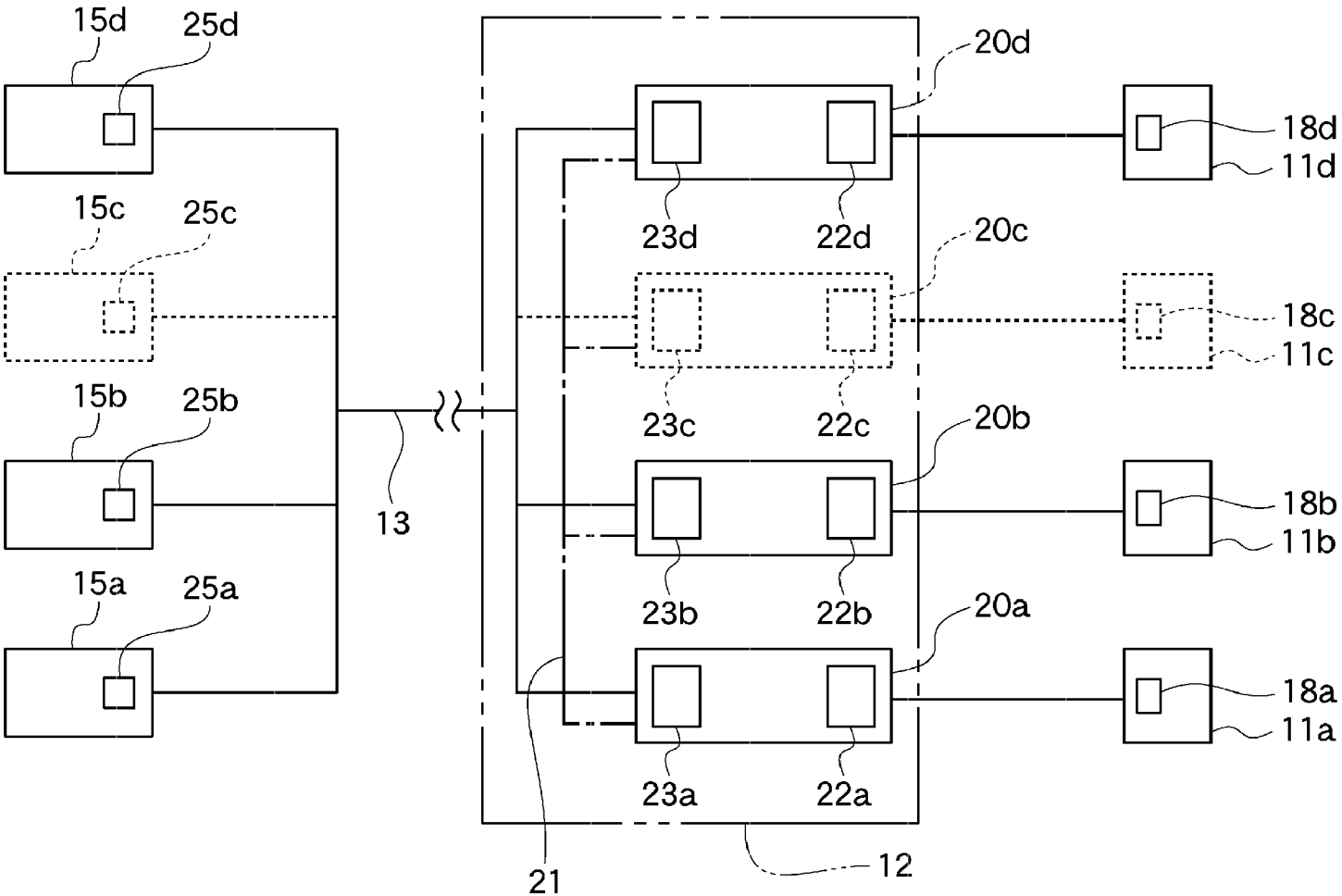
FIG. 2 is a block diagram, showing a part of a control area network according to one embodiment.
Figure 3:
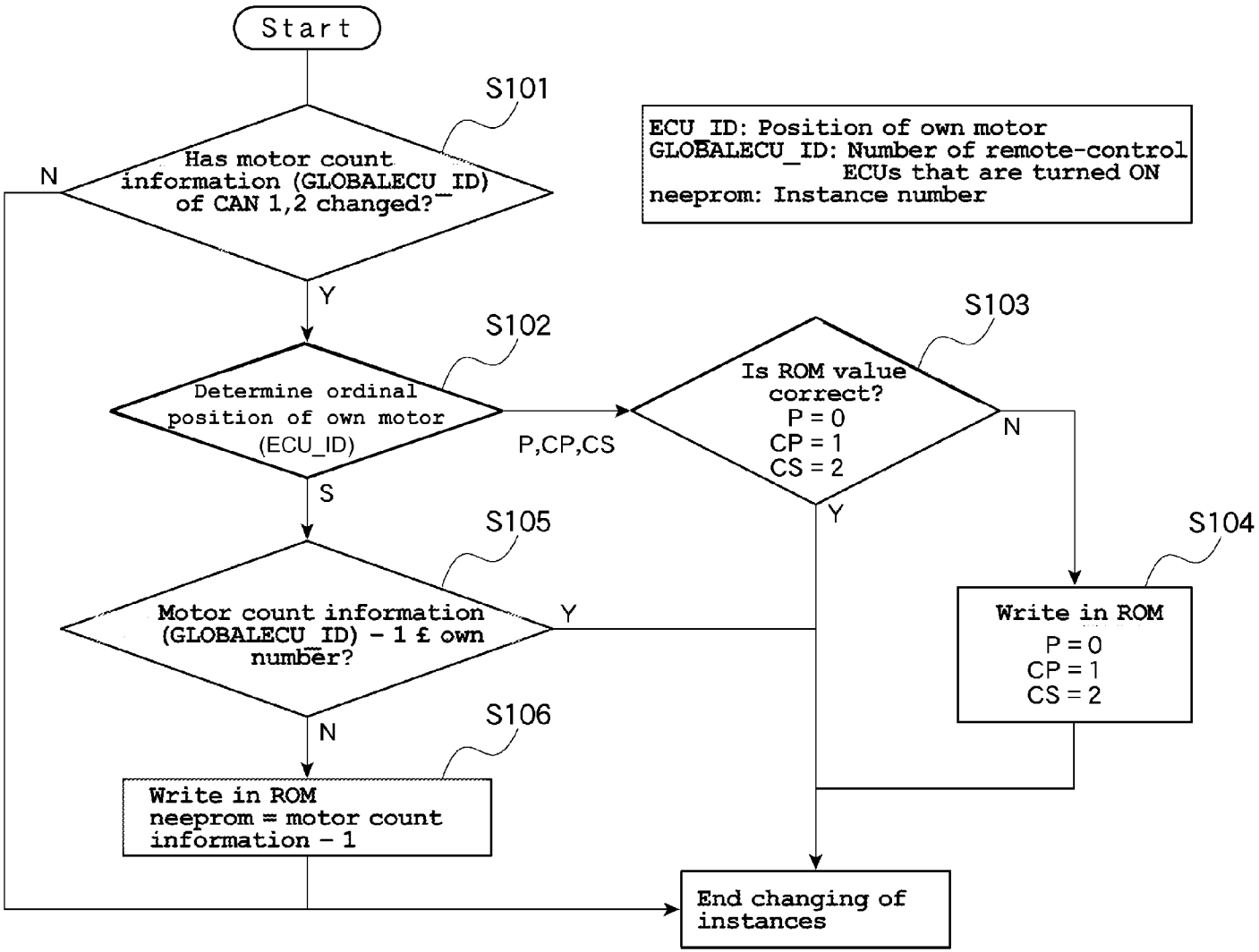
FIG. 3 is a flowchart, showing a procedure for setting device instance numbers according to one embodiment.

FIGS. 1 to 3 show one embodiment of a boat and control area network. In FIG. 1, reference numeral 10 denotes a boat. In the boat 10, a plurality of propulsion units are provided at the rear portion of a hull. In the illustrated embodiment, the propulsion units are outboard motors 11*a*-11*d*. However, the propulsion units can include other types of motors or engines and are not limited to outboard motors. Additionally, the number of outboard motors 11*a*-11*d* can be more or fewer than those disclosed in the illustrated embodiment.

The boat 10 also includes a remote control unit 12 to operate the outboard motors 11*a* to 11*d* is provided at the front portion of the hull, and gauge sections 15*a* to 15*d* corresponding to the respective outboard motors 11*a* to 11*d* are provided for displaying the operation information (e.g., navigation speed, remaining fuel amount, engine speed and engine temperature, etc.) of the respective outboard motors 11*a* to 11*d*. These components can be connected to each other via a network cable 13, thus constructing a control area network (CAN). However, in other embodiments, communication between these components, or between other components described herein, can be done via a wireless connection (e.g., Rf communication).

As shown in FIG. 2, the remote control unit 12 can include remote-control-side ECUs 20*a* to 20*d*, e.g. as control units corresponding to the respective outboard motors 11*a* to 11*d*, for transmitting control information to motor-side ECUs 18*a* to 18*d* of the outboard motors 11*a* to 11*d* for driving and controlling various actuators, and for receiving operation information from the outboard motors 11*a* to 11*d*. The remote-control-side ECUs 20*a* to 20*d* can be connected to each other by a communication line 21 so as to allow mutual communication.

The respective remote-control-side ECUs 20*a* to 20*d* can include determining sections 22*a* to 22*d* for determining the positions of the corresponding outboard motors 11*a* to 11*d*. The remote-control-side ECUs 20*a* to 20*d* can transmit information specified by the determining sections 22*a* to 22*d* with respect to the motor-side ECUs 18*a* to 18*d* of the outboard motors 11*a* to 11*d*. It should be noted that in FIG. 2, the respective remote-control-side ECUs 20*a* to 20*d* and the outboard motors 11*a* to 11*d* are depicted as being directly wire-connected to each other. However, as noted above, in another embodiment, the remote-control-side ECUs 20*a* to 20*d* can communicate in a wireless manner with the outboard motors 11*a* to 11*d*.

The respective remote-control-side ECUs 20*a* to 20*d* are configured to be capable of assigning mutually different device instance (DI) numbers to various information in order to transmit the various information via the network cable 13. The respective remote-control-side ECUs 20*a* to 20*d* include DI-number setting sections 23*a* to 23*d* for setting those device instance numbers.

The DI-number setting sections 23*a* to 23*d* can each include an EEPROM (not shown) for storing each device instance number. Each of the respective remote-control-side ECUs 20*a* to 20*d* can read a device instance number stored in this EEPROM and assign the device instance number to various information.

In this case, the operation information of the outboard motors 11*a* to 11*d* can be transmitted from the respective motor-side ECUs 18*a* to 18*d* to the respective corresponding remote-control-side ECUs 20*a* to 20*d*. In the remote-control-side ECUs 20*a* to 20*d*, device instance numbers are assigned to the operation information of the respective corresponding outboard motors 11*a* to 11*d* and transmitted to the network cable 13.

On the other hand, the respective gauge sections 15*a* to 15*d* can include DI-number identifying sections 25*a* to 25*d* that can each set a device instance number in advance, and identify and receive operation information assigned with the same device instance number as the set device instance number.

Accordingly, in the respective gauge sections 15*a* to 15*d* corresponding to the remote-control-side ECUs 20*a* to 20*d* and the outboard motors 11*a* to 11*d*, the operation information of the respective outboard motors 11*a* to 11*d* transmitted to the communication network from the respective remote-control-side ECUs 20*a* to 20*d* are received for display by identifying the device instance numbers.

In the boat 10 as described above, the DI-number setting sections 23*a* to 23*d* of the remote-control-side ECUs 20*a* to 20*d* set mutually different device instance numbers by using successive integers starting from 0 in accordance with the order of the positions of the outboard motors 11*a* to 11*d*.

In the case where the number of motors mounted is 4 or less, for example, the respective device instance numbers of an outboard motor (hereinafter, referred to as "P" motor as required) 11*a* on the port side of the stern, an outboard motor (hereinafter, referred to as "C" or "CP" motor as required) 11*b* on the central port side, an outboard motor (hereinafter, referred to as "CS" motor as required) 11*c* on the central starboard side, and an outboard motor (hereinafter, referred to as "S" motor) 11*d* on the starboard side are set as described in Table 1 below in this embodiment.

TABLE 1

| Number of motors | P motor 11b | CP motor 11b | CS motor 11c | S motor 11d |
|---|---|---|---|---|
| One-motor mounting | 0 | — | — | — |
| Two-motor mounting | 0 | — | — | 1 |
| Three-motor mounting | 0 | 1 | — | 2 |
| Four-motor mounting | 0 | 1 | 2 | 3 |

As is apparent from Table 1, when the number of the outboard motors 11*a* to 11*d* is increased, the device instance numbers based on positional order does not change with respect to the P motor 11*a*, the CP motor 11*b*, and the CS motor 11*c*, and the device instance number changes with respect to the S motor 11*d*.

Accordingly, in the DI-number setting sections 23*a* to 23*d* of the remote-control-side ECUs 20*a* to 20*d*, the procedure for setting device instance numbers based on such differentiation between the S motor 11*d* and the other motors is established.

Device instance numbers can be set in such a way that the respective remote-control-side ECUs 20*a* to 20*d* recognize the total number N of all the remote-control-side ECUs 20*a* to 20*d*, and determine the positions of the outboard motors 11*a* to 11*d* corresponding to the respective remote-control-side ECUs 20*a* to 20*d*.

With respect to the DI-number setting sections 23*a* to 23*c* corresponding to the P motor 11*a*, the CP motor 11*b*, and the CS motor 11*c* other than the S motor 11*d* that is placed last in the positional order of the outboard motors 11*a* to 11*d*, successive integers that accord with the positional order are set as the device instance numbers. On the other hand, with respect to the DI-number setting section 23*d* corresponding to the S motor 11*d* that is placed last in the positional order, an integer that accords with the total number N of the remote-control-side ECU 20*a* to 20*d* and successive to the device instance numbers of the DI-number setting sections 23*a* to 23*c*, that is, N−1, is set as the device instance number.

The device instance number setting procedure as described above can be executed for each of the remote-control-side ECUs 20*a* to 20*d*. The procedure can be executed during initial setting, normal usage, system modification in the case of multiple-motor mounting, and the like.

The above-mentioned device instance number setting procedure will be specifically described with reference to FIG. 3 by way of an example of a 3-motor boat 10. In the case of a 3-motor configuration, there are provided the P motor 11*a*, the C motor 11*b*, and the S motor 11*d*. Further, three motor-side ECUs 18*a*, 18*b*, 18*d* and three gauge sections 15*a*, 15*b*, 15*d* corresponding to these motors are provided.

First, at the time of initial setting, in step S101, count information on the number of the remote-control-side ECUs 20*a*, 20*b*, 20*d* corresponding to the P motor 11*a*, the C motor 11*b*, the S motor 11*d* in the power ON state within a communication network is recognized through communication using the communication line 21. In this case, "3" as the total number N is recognized. Since no previous count information exists at the time of initial setting, the process advances to step S102 as it is.

In step S102, the positions of the P motor 11*a*, C motor 11*b*, S motor 11*d* are determined by the determining sections 22*a*, 22*b*, 22*d*. In this case, the ECUs 20*a*, 20*b*, 20*d* acquire information on the P motor, C motor, S motor stored in the outboard motors 11*a*, 11*b*, 11*d* to which the ECUs 20*a*, 20*b*, 20*d* are respectively connected. That is, it is recognized that the ECUs 20*a*, 20*b*, 20*d* are connected to the P motor 11*a*, the C motor 11*b*, and the S motor 11*d*, respectively. It should be noted that the C motor 11*b* is processed as the CP motor in this procedure. In step S102, the S motor 11*d*, which is placed last in the positional order, and the other motors are differentiated from each other. The process then advances to the next step S103 or step S105.

In the remote-control-side ECUs 20*a*, 20*b* corresponding to the P motor 11*a* and C motor 11*b*, other than the S motor 11*d*, the process advances to step S103, and since no previously stored ROM value exists at the time of initial setting, the process advances to step S104 as it is.

In step S104, device instance numbers are set as successive integers starting from 0, in accordance with the positional order in which the respective motors 11*a*, 11*b* are placed. First, the integer "0" is set as the device instance number with respect to the DI-number setting section 23*a* of the remote-control-side ECU 20*a* corresponding to the P motor 11*a* that is placed first as seen from the port side. Also, the next integer "1" succeeding to the device instance number "0" set with respect to the DI-number setting section 23*a* is set as a device instance number with respect to the DI-number setting section 23*b* of the remote control-side ECU 20*b* corresponding to the C motor 11*b* that is positioned next to the P motor 11*a* in the placement order. These device instance numbers are written and stored in the respective EEPROMs.

On the other hand, in the remote-control-side ECU 20*d* corresponding to the S motor 11*d* that is placed last in the positional order, the process advances to step S105 following step S102, and since no previously set number exists at the time of initial setting, the process advances to step S106 as it is.

In step S106, in accordance with the total number N as the count information on all of the remote-control-side ECUs 20*a*, 20*b*, 20*d* recognized by the communication line 21, and in succession to the integers "0" and "1" of the DI-number setting sections 23*a*, 23*b*, the integer "2" equal to N−1 obtained by subtracting 1 from the total number N is set as the device instance number with respect to the DI-number setting section 23*d* of the remote-control-side ECU 20*d*, and is written and stored in the EEPROM.

This completes the procedure for setting mutually different device instance numbers to the DI-number setting sections 23*a*, 23*b*, 23*d* at initial setting.

Next, the flow of procedure during normal usage of the boat 10 following initial setting will be described.

In step S101, the respective DI-number setting sections 23*a*, 23*b*, 23*d* recognize the count information on the number of the remote-control-side ECUs 20*a*, 20*b*, 20*d* corresponding to the outboard motors 11*a*, 11*b*, 11*d* in the power ON state through the communication line 21, and then execute the procedure.

When, during normal usage of the boat 10 with three motors, the P motor 11*a*, the C motor 11*b*, and the S motor 11*d*, turned ON, in step S101, it is determined whether or not the count information has changed from that at the time of initial setting. Since the count information has not changed, the procedure is ended as it is.

On the other hand, during normal usage with two motors, the P motor 11*a* and the S motor 11*d*, turned ON, for example, it is determined in step S101 whether or not the count information indicating the number of motors in the power ON state has changed from that at the time of initial setting. Since the count information has changed, the process advances to step S102.

In step S102, the positions of the P motor 11*a* and S motor 11*d* are determined by the determining sections 22*a*, 22*d*. Then, the S motor 11*d*, which is placed last in the positional order, and the other motors are differentiated from each other. The process then advances to the next step S103 or step S105.

In the remote-control-side ECU 20*a* corresponding to the P motor 11*a*, other than the S motor 11*d*, the process then advances to step S103, and it is determined whether or not the device instance number stored in the EEPROM of the DI-number setting section 23*a* is correct, that is, whether or not the device instance number is the integer "0" that accords with the positional order of the P motor 11*a*.

At this time, in the outboard motors other than the S motor 11*d*, the device instance number does not change in the normal operation state. Accordingly, "0" stored in the EEPROM of the DI-number setting section 23*a* is correct, and thus the procedure is ended as it is.

On the other hand, in the remote-control-side ECU 20*d* corresponding to the S motor 11*d* that is placed last in the positional order, the process advances to step S105 after step S102.

In step S105, it is determined whether or not the device instance number "2" stored in the EEPROM of the DI-number setting section 23*d* has increased. In this case, it is determined whether or not the device instance number indicates a value equal to or larger than a value that accords with the count information on the number of the remote-control-side ECUs 20*a*, 20*d* corresponding to the P motor 11*a*, S motor 11*d* that are in the power ON state, that is, whether or not the device instance number is smaller than the integer "1" obtained by subtracting 1 from the total number "2."

In this case, since the stored device instance number "2" is larger than the value "1" that accords with the count information, the procedure is ended as it is.

Therefore, in the procedure during the normal usage of the boat 10 after initial setting, the respective device instance numbers set in the DI-number setting sections 23*a*, 23*b*, 23*d* at the initial setting are not changed, and the numbers stored in the respective EEPROMs are used as they are.

Lastly, description will be given of a case where a multiple-motor system is changed by additionally providing the CS motor 11*c* between the C motor (hereinafter, referred to as CP motor as required) and S motor 11*d* of the boat 10, and additionally providing the motor-side ECU 18*c* and gauge section 15*c* corresponding to the CS motor 11*c*.

In this case, first, in step S101, upon turning ON all of the P motor 11*a*, the CP motor 11*b*, the CS motor 11*c*, and the S motor 11*d*, it is determined whether or not the count information indicating the number of motors in the power ON state has changed from that at the initial setting. Since the determination result indicates that the count information has changed, the process advances to step S102.

In step S102, the positions of the P motor 11*a*, the CP motor 11*b*, the CS motor 11*c*, and the S motor 11*d* are determined by the determining sections 22*a* to 22*d*. In step S102, the S motor 11*d*, which is placed last in the positional order, and the other motors are differentiated from each other. The process then advances to the next step S103 or step S105.

In the remote-control-side ECUs 20*a*, 20*b*, 20*c* corresponding to the P motor 11*a*, the CP motor 11*b*, the CS motor 11*c* other than the S motor 11*d* that is placed last in the positional order, the process then advances to step S103, and it is determined whether or not the device instance numbers stored in the EEPROMs of the DI-number setting sections 23*a*, 23*b* are correct. Since the device instance number does not change in the normal operation state with respect to the P motor 11*a* and the CP motor 11*b*, the device instance numbers "0" and "1" respectively stored in the EEPROMs of the DI-number setting sections 23*a*, 23*b*, 23C are correct, so the procedure is ended as it is.

As for the DI-number setting section 23*c* of the CS motor 11*e*, since it is newly added, there is no device instance number stored in the EEPROM. The process thus advances to step S104.

In step S104, in accordance with the positional order of the CS motor 11*c*, the integer "2" is set as the device instance number with respect to the DI-number setting section 23*c* of the corresponding remote-control-side ECU 20*c*, and is written and stored in the EEPROM.

On the other hand, in step S102, in the remote-control-side ECU 20*d* corresponding to the S motor 11*d* that is placed last in the positional order, the process advances to step S105 after step S102.

In step S105, it is determined whether or not the device instance number "2" stored in the EEPROM of the DI-number setting section 23*d* has increased. That is, it is determined whether or not the device instance number indicates a value equal to or larger than the count information on the number of the remote-control-side ECUs 20*a* to 20*d* corresponding to the P motor 11*a*, the CP motor 11*b*, the CS motor 11*c*, and the S motor 11*d* that are in the power ON state.

In this case, while the device instance number stored in the EEPROM is "2", the value that accords with the count information is the integer "3" obtained by subtracting 1 from the total number "4." The stored device instance number is thus larger than the value that accords with the count information. This means an increase in the device instance number of the DI-number setting section 23*d* of the remote-control-side ECU 20*d*, so the process advances to step S106.

In step S106, the integer "3," which is obtained by subtracting 1 from the total number "4" of all the remote-control-side ECUs 20*a* to 20*d* which accords with the count information as recognized by the communication line 21, is reset as the device instance number for the DI-number setting section 23*d* of the remote-control-side ECU 20*d*, and is written and stored in the EEPROM.

The procedure for setting mutually different device instance numbers with respect to the DI-number setting sections 23*a* to 23*d* is thus ended.

In the boat 10 in which different device instance numbers are assigned to the respective DI-number setting sections 23*a* to 23*d* of the remote-control-side ECUs 20*a* to 20*d* as described above, since each of the remote-control-side ECUs 20*a* to 20*d* is connected to all the other remote-control-side ECUs 20*a* to 20*d* by the communication line 21, each of the remote-control-side ECUs 20*a* to 20*d* can recognize the total number N of all the remote-control-side ECUs 20*a* to 20*d*.

Further, since the respective remote-control-side ECUs 20*a* to 20*d* include the determining sections 22*a* to 22*d* that can determine the positions of the outboard motors 11*a* to 11*d* corresponding to the remote-control-side ECUs 20*a* to 20*d*, the respective remote-control-side ECUs 20*a* to 20*d* can determine the positions of the outboard motors 11*a* to 11*d* corresponding to the remote-control-side ECUs 20*a* to 20*d*.

Accordingly, it is possible to recognize the ordinal position of an outboard motor among all the outboard motors 11*a* to 11*d* to which each of the remote-control-side ECUs 20*a* to 20*d* corresponds, thereby making it possible to set device instance numbers according to the order of placement. As a result, even when the outboard motors 11*a* to 11*d* are activated in an arbitrary order, device instance numbers that accord with the placement order of the outboard motors 11*a* to 11*d* can be assigned to the remote-control-side ECUs 20*a* to 20*d*.

Further, in each of the DI-number identifying sections 25*a* to 25*d* of the respective gauge sections 15*a* to 15*d*, a device instance number corresponding to the device instance number set in each of the DI-number setting sections 23*a* to 23*d* of the remote-control-side ECUs 20*a* to 20*d* can be set in advance, and operation information assigned with the same device instance number as this device instance number can be identified and received. Accordingly, on the basis of the respective device instance numbers, it is possible to reliably transmit the operation information of the respective outboard motors 11*a* to 11*d* from the remote-control-side ECUs 20*a* to 20*d* to the corresponding gauge sections 15*a* to 15*d* via the communication network cable 13.

Further, each of the DI-number setting sections 23*a* to 23*d* includes the EEPROM storing a device instance number, and is configured to read the device instance number stored in this EEPROM and assign the device instance number to the operation information of each of the outboard motors 11*a* to 11*d*. Accordingly, once the device instance number is stored in the EEPROM, frequent setting of the device instance number is not required, thereby facilitating control.

Further, integers that accord with the positional order are set as device instance numbers with respect to the DI-number setting sections 23*a* to 23*c* corresponding to the outboard motors 11*a* to 11*c* other than the outboard motor 11*d* that is placed last in the positional order of the outboard motors 11*a* to 11*d*. Accordingly, even when the number of the outboard motors 11*a* to 11*d* is increased or decreased after the initial setting, there is no need to change the placement order, and hence there is no need to reset the device instance numbers in the remote-control-side ECUs 20*a* to 20*c* and gauge sections 15*a* to 15*c* corresponding to the outboard motors 11*a* to 11*c*.

As a result, when, after mounting one or a plurality of the outboard motors 11*a* to 11*d* and performing device instance number setting, the number of the outboard motors 11*a* to 11*d* is increased or decreased, it suffices to reset the device instance number with respect to the remote-control-side ECU 20*d* and gauge section 15*d* corresponding to the outboard motor 11*d* that is placed last in the positional order of the outboard motors 11*a* to 11d, and the device instance numbers with respect to the remote-control-side ECUs 20*a* to 20*c* and gauge sections 15*a* to 15*c* corresponding to the other outboard motors 11*a* to 11*c* can be set so as to be fixed. Accordingly, the procedure for resetting device instance numbers in the DI-number setting sections 23*a* to 23*d* can be simplified. At the same time, since it is possible to keep the number of times of writing to the EEPROM small, it is also possible to achieve an improvement in terms of durability.

Moreover, when the number of the remote-control-side ECUs 20*a* to 20*d* corresponding to the outboard motors 11*a* to 11*d* in the power ON state has changed, the device instance number is reset and stored in the EEPROM in the case where there is an increase in the device instance number of the remote-control-side ECU 20*d* corresponding to the outboard motor 11*d* that is placed last in the positional order of the outboard motors 11*a* to 11*d*. Accordingly, the device instance number can be reset in limited circumstances such as when the number of the outboard motors 11*a* to 11*d* in the boat has been increased or when the device instance number stored in the EEPROM has changed, thereby reducing the number of times a device instance number is written to the EEPROM and facilitating an improvement in durability.

In the embodiment mentioned above, when setting device instance numbers in accordance with the positional order, the device instance numbers can be set in accordance with the placement order of the outboard motors 11*a* to 11*d* from the port side. However, this should not be construed restrictively. In other embodiments, the device instance numbers can be set in accordance with any other order, such as one based on positions defined previously.

Figure 4:
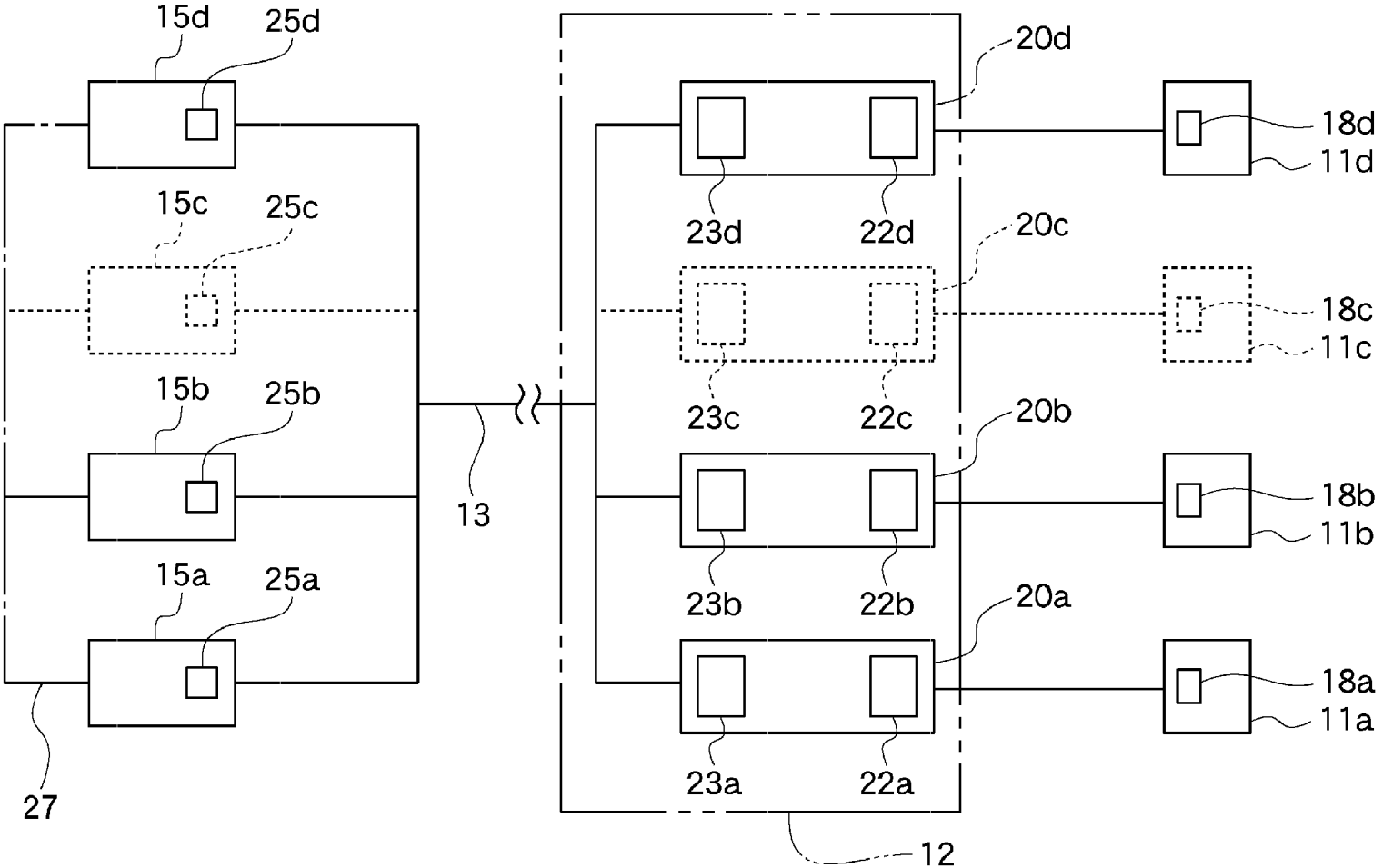
FIG. 4 is a block diagram, showing a part of a control area network according to another embodiment.

FIG. 4 shows another embodiment of a control area network.

The boat 10 according to this embodiment can be of the same configuration as that of the embodiment illustrated in FIG. 2, except in that the respective gauge sections 15*a* to 15*d* are connected to each other by a communication line 27. The DI-number identifying sections 25*a* to 25*d* of the respective gauge sections 15*a* to 15*d* can specify the corresponding remote-control-side ECUs 20*a* to 20*d* based on the number of the gauge sections 15*a* to 15*d* and device instance numbers that can be set in advance, and assign the device instance numbers to the remote-control-side ECUs 20*a* to 20*d*. It should be noted that although the communication line 21 for connecting the respective remote-control-side ECUs 20*a* to 20*d* in a manner allowing mutual communication is not provided, the communication line 21 may be provided.

In the case of the boat 10 configured as described above as well, the same effect can be attained as that of the embodiment shown in FIG. 2. First, in the embodiment illustrated in FIG. 4, since the respective gauge sections 15*a* to 15*d* are connected to each other by the communication line 27, each of the DI-number identifying sections 25*a* to 25*d* of the respective gauge sections 15*a* to 15*d* can recognize the number of the gauge sections 15*a* to 15*d*. Further, since device instance numbers made up of a succession of integers that are different from each other, preferably, integers that accord with the placement order can be set in advance with respect to the respective gauge sections 15*a* to 15*d*, it is possible to identify the ordinal position of an outboard motor among all the outboard motors 11*a* to 11*d* to which each of the gauge sections 15*a* to 15*d* is made to correspond.

On the other hand, since the respective determining sections 22*a* to 22*d* of the remote-control-side ECUs 20*a* to 20*d* can determine the positions of the outboard motors 11*a* to 11*d* corresponding to the respective remote-control-side ECUs 20*a* to 20*d*, it is possible to recognize which one of the outboard motors 11*a* to 11*d* each of the remote-control-side ECUs 20*a* to 20*d* corresponds to, and therefore identify the remote-control-side ECUs 20*a* to 20*d* corresponding to the respective gauge sections 15*a* to 15*d*. Accordingly, with respect to the DI-number setting sections 23*a* to 23*d* of the respective remote-control-side ECUs 20*a* to 20*d*, device instance numbers set in the corresponding gauge sections 15*a* to 15*d* can be set.

As a result, even when the outboard motors 11*a* to 11*d* are activated in an arbitrary order, device instance numbers that accord with the placement order of the outboard motors 11*a* to 11*d* can be assigned to the remote-control-side ECUs 20*a* to 20*d* and the gauge sections 15*a* to 15*d*.

Although these inventions have been disclosed in the context of a certain preferred embodiments and examples, it will be understood by those skilled in the art that the present inventions extend beyond the specifically disclosed embodiments to other alternative embodiments and/or uses of the inventions and obvious modifications and equivalents thereof. In addition, while a number of variations of the inventions have been shown and described in detail, other modifications, which are within the scope of the inventions, will be readily apparent to those of skill in the art based upon this disclosure. It is also contemplated that various combinations or subcombinations of the specific features and aspects of the embodiments may be made and still fall within one or more of the inventions. Accordingly, it should be understood that various features and aspects of the disclosed embodiments can be combine with or substituted for one another in order to form varying modes of the disclosed inventions. Thus, it is intended that the scope of the present inventions herein disclosed should not be limited by the particular disclosed embodiments described above.

What is claimed is:

1. A boat comprising:

a plurality of boat propulsion units;

a plurality of control units for controlling the plurality of boat propulsion units; and a plurality of gauge sections for displaying operation information of the boat propulsion units, the plurality of control units and the plurality of gauge sections connected to each other via a communication network, the control units configured to assign different device instance (DI) numbers to operation information of the corresponding boat propulsion units and configured to transmit the operation information with the assigned device instance number, each gauge section configured to identify the device instance numbers to receive and display the operation information of the corresponding boat propulsion unit, the plurality of control units connected to each other via one or more communication lines, each control unit including a DI-number setting section capable of setting the device instance number, and a determining section capable of determining a position of the boat propulsion unit corresponding to the control unit, the DI-number setting section configured to set the device instance number based on the number of the control units recognized with the one or more communication lines and the position of the boat propulsion unit determined by the determining section wherein the DI-number setting section of each control unit sets the device instance number so that the device instance number accords with the ordinal placement order of the corresponding propulsion unit even when the plurality of boat propulsion units are activated in an order different from the order of their placement on the boat.

2. The boat of claim 1, wherein the device instance number corresponding to the device instance number of the control unit is set in advance for each of the gauge sections, and each of the gauge sections includes a DI-number identifying section capable of identifying and receiving the operation information assigned with the same device instance number as the device instance number set in the gauge section.

3. The boat of claim 1, wherein the one or more communication lines are hard-wire communication lines.

4. The boat of claim 1, wherein at least one of the gauge sections is a navigation speed gauge.

5. The boat of claim 1, wherein at least one of the gauge sections is a fuel gauge.

6. The boat of claim 1 , wherein at least one of the gauge sections is an engine speed gauge.

7. The boat of claim 1, wherein at least one of the gauge sections is an engine temperature gauge.

8. A boat comprising:

a plurality of boat propulsion units;

a plurality of control units for controlling the plurality of boat propulsion units; and a plurality of gauge sections for displaying operation information of the boat propulsion units, the plurality of control units and the plurality of gauge sections connected to each other via a communication network, the control units configured to assign different device instance (DI) numbers to operation information of the corresponding boat propulsion units and configured to transmit the operation information with the assigned device instance number, each gauge section configured to identify the device instance numbers to receive and display the operation information of the corresponding boat propulsion units, each of the control units including a DI-number setting section capable of setting the device instance number, and a determining section capable of determining the position of the boat propulsion unit corresponding to the control unit;

the gauge sections connected to each other via a communication line, the device instance numbers with values different from each other being set in advance for each of the gauge sections, each gauge section including a DI-number identifying section capable of identifying and receiving the operation information assigned with the same device instance number as the device instance number set for the gauge section, the DI-number identifying section identifying the corresponding control unit based on the number of the gauge sections and the device instance number, and setting the device instance number in the DI-number setting section of the control unit wherein the DI-number setting section of each control unit sets the device instance number in accordance with the ordinal placement order of the corresponding propulsion unit irrespective of the order in which the plurality of boat propulsion units are activated.

9. The boat of claim 8, wherein the DI-number setting section includes a ROM for storing the device instance number, and is adapted to read the device instance number stored in the ROM and assign the device instance number to the operation information of the boat propulsion unit.

10. The boat of claim 9, wherein the DI-number setting sections corresponding to the boat propulsion units other than the boat propulsion unit that is placed last in the positional order of the boat propulsion units set, as the device instance numbers, successive integers that accord with said positional order; and the DI-number setting section corresponding to the boat propulsion unit that is placed last in the positional order sets, as the device instance number, an integer in accord with the number of the control units and succeeding to the successive integers.

11. The boat of claim 10, wherein when the number of the control units corresponding to the boat propulsion units in a power ON state has changed, where there is an increase in the device instance number of the control unit corresponding to the boat propulsion unit that is placed last in the positional order, the DI-number setting section resets the device instance number and stores the reset device instance number in the ROM.

12. The boat of claim 8, wherein the communication network comprises a network cable.

13. The boat of claim 8, wherein at least one of the gauge sections is a navigation speed gauge.

14. The boat of claim 8, wherein at least one of the gauge sections is a fuel gauge.

15. The boat of claim 8, wherein at least one of the gauge sections is an engine speed gauge.

16. The boat of claim 8, wherein at least one of the gauge sections is an engine temperature gauge.

* * * * *

UNITED STATES PATENT AND TRADEMARK OFFICE

CERTIFICATE OF CORRECTION

PATENT NO. : 7,559,812 B2
APPLICATION NO. : 11/694422
DATED : July 14, 2009
INVENTOR(S) : Yamada et al.

It is certified that error appears in the above-identified patent and that said Letters Patent is hereby corrected as shown below:

At column 11, line 58, please delete "section", and insert --section,--, therefor.

At column 12, line 51, please delete "unit", and insert --unit,--, therefor.

Signed and Sealed this

Nineteenth Day of January, 2010

David J. Kappos

David J. Kappos
*Director of the United States Patent and Trademark Office*